United States Patent [19]

Morell

[11] Patent Number: 5,064,199

[45] Date of Patent: Nov. 12, 1991

[54] GOLF BALL

[75] Inventor: Joseph Morell, Annecy le Vieux, France

[73] Assignee: Taylor Made Golf Company, Inc., Carlsbad, Calif.

[21] Appl. No.: 645,637

[22] Filed: Jan. 25, 1991

[30] Foreign Application Priority Data

Jan. 25, 1990 [FR] France ..... 90 00857

[51] Int. Cl.[5] ..... A63B 37/14

[52] U.S. Cl. ..... 273/232; 40/327

[58] Field of Search ..... 273/232, 220, 62; 40/327

[56] References Cited

U.S. PATENT DOCUMENTS 4,772,026 9/1988 Gobush ..... 273/232

FOREIGN PATENT DOCUMENTS 2216017 10/1989 United Kingdom ..... 273/232

*Primary Examiner*—George J. Marlo

*Attorney, Agent, or Firm*—Sandler, Greenblum & Bernstein

[57] ABSTRACT

A golf ball having a peripheral surface with dimples distributed essentially within a plurality of first identical elemental surfaces in the form of irregular spherical pentagons; a plurality of second identical elemental surfaces in the form of spherical equilateral triangles; and a plurality of third identical elemental surfaces in the form of spherical isosceles triangles, these elemental surfaces being defined by six equatorial circles of the sphere generally defining the peripheral surface of the golf ball. By a judicious choice in the relative positions of the equatorial circles, of the distribution, and of the diameters of the circles of intersection, the orientation of the ball with respect to impact therewith can be rendered relatively irrelevant.

16 Claims, 3 Drawing Sheets

GOLF BALL

BACKGROUND OF THE INVENTION

1. Field of the Invention

The present invention relates to a golf ball of the type which has a peripheral surface having the general form of a sphere and a plurality of hollowed portions or dimples provided in the peripheral surface and defining, by their intersections therewith, circles of intersection distributed over the peripheral surface along a repetitive pattern, essentially within the elemental surfaces defined by the arcs of six equatorial circles of the sphere.

2. Description of Background and Relevant Information

A golf ball of the aforementioned type is generally described in U.S. Pat. No. 4,772,026, which provides for a construction of six equatorial circles from a cube inscribed within a sphere, in a manner so as to define twenty-four elemental identical surfaces in the form of spherical isosceles right triangles, in which the circles of intersection can be distributed along a certain number of patterns, described with reference to FIGS. 2–7 and 9–14 of the aforementioned U.S. patent.

In a general fashion, this known method of distribution of intersection circles, i.e., dimples, has a heterogeneity such that it makes it possible to locally provide, from the peripheral spherical surface of the golf ball, relatively substantial regions having no dimples, such that the user is constrained to carefully orient his or her ball before striking it, if it is desired to take advantage of a substantial probability of making contact with the peripheral surface of the ball in the zones of this surface having a geometry which is approximately identical for each hit, so as to ensure reproducibility of hits.

SUMMARY OF THE INVENTION

An object of the present invention is to overcome the foregoing disadvantage by providing a type of geometrical construction having six equatorial circles of subdivision of the peripheral spherical surface of the ball, making it possible to achieve a more homogenous distribution of the intersection circles, i.e., the dimples, on the surface.

To this end, the present invention proposes a golf ball of the type indicated above, wherein the six equatorial associated with one, respectively, of the three equatorial planes which are secant, two by two, at right angles, along axes which are themselves secant, two by two, at right angles, to the center of the sphere, and, on the other hand, to one, respectively, of the axes, each group comprising two equatorial circles which are secant to the corresponding respective axis, mutually symmetrical with respect to the equatorial plane which respectively corresponds, and offset angularly with respect thereto by a non-zero angle, less than 45°, different from 31° 43′ 03″, and identical from one group to the other in a manner so as to define:

- twelve first identical elemental surfaces, each in the form of a spherical irregular pentagon;
- eight second identical elemental surfaces, each in the form of a spherical equilateral triangle; and
- twelve third identical elemental surfaces, each in the form of a spherical isosceles triangle.

The aforementioned offset angle of 31° 43′ 03″, not preferred in the present invention, corresponds to a regular configuration of the elemental surfaces in the form of twelve identical elemental surfaces in the form of spherical regular pentagons and twenty identical elemental surfaces in the form of equilateral triangles.

It will be easily understood that the distribution of the intersection circles within the more numerous elemental surfaces makes it possible to refine the distribution of the intersection circles, i.e., the dimples, on the spherical peripheral surface of the golf ball and thus to make it possible to reduce the areas of this spherical peripheral surface existing between the intersection circles, i.e., between the dimples.

As long as one avoids, for an angular offset angle of the two equatorial circles of each group with respect to the corresponding respective equatorial plane, the values 0°, 45° and 31° 43′ 03″, corresponding to a subdivision of the spherical peripheral surface of the golf ball, respectively, into eight spherical equilateral triangles, into twenty-four spherical isosceles triangles (as is taught by the above-mentioned U.S. patent) and, on the one hand, regular spherical pentagons and, on the other hand, twenty equatorial spherical triangles, each value of the angular offset angle can be selected and associated with a respective pattern of distribution of the circles of intersection, i.e., the dimples, in the different identical elemental surfaces.

However, an angular offset angle on the order of 26.29°, i.e., 26° 17′ 24″, is actually preferred, to the extent that it has made it possible to obtain an exceptionally homogenous distribution of the aforementioned intersection circles, i.e., of the dimples, over the spherical peripheral surface of the golf ball, as well as to obtain a reduction of the areas of this surface existing between the circles of intersection to a minimum.

According to this preferred distribution:

- each first elemental surface, defined by two first arcs of the same length, which are mutually adjacent, two second arcs of the same length, each of which is adjacent to a first respective arc, and a third arc, mutually connecting the two second arcs, comprises twenty-three circles of intersection configured as follows:
  - two rows, each in the form of a V comprising five first circles of intersection of the same diameter D1, which are mutually adjacent, and whose circles of intersection of the first row are adjacent to the two first arcs, two extreme first circles of intersection of the two rows being respectively adjacent to the second respective arcs;
  - a third row, in the form of a V comprising five second circles of intersection of the same diameter D2, which are mutually adjacent and adjacent to the second row of the first circles of intersection, two extreme second circles of intersection being respectively adjacent to the second respective arcs;
  - a fourth row, substantially in the form of a V comprising four second circles of intersection of the same diameter D2, which are adjacent to the third row, two extreme third circles of intersection being respectively adjacent to the second respective arcs;
  - a fifth row, comprising three fourth circles of intersection of the same diameter D2, which are mutually adjacent and adjacent to the third arc connecting the two second arcs; two of the three fourth extreme circles being adjacent respectively to the respective second arcs; and a fifth circle of intersection of diameter D2, which is respectively adjacent to the two third circles of intersection of the fourth row and to the fourth circle of median intersection of the fifth row;

each second elemental surface comprises ten circles of intersection of the same diameter D1 as the first circles of intersection, distributed into three rows of four circles of intersection which are mutually adjacent and adjacent to a respective arc, each row having two end circles of intersection which are common to a respective adjacent row, two intermediate circles of intersection, and a central intersection circle adjacent to the intermediate intersection circles of the three rows; and finally, each third elemental surface comprises three circles of intersection which are distributed into:

two circles of intersection of diameter D2 which are adjacent to the circular arc forming the base of the spherical isosceles triangle of the elemental surface; and a circle of intersection of diameter D1 adjacent to the two other circles of intersection.

Considering a golf ball whose spherical peripheral surface has a diameter on the order of approximately 42.67 mm (millimeters) and by selecting the diameters D1 and D2 on the order of approximately 3.5 mm and approximately 3.2 mm, respectively, one thus obtains a value on the order of 61% for the amount of total coverage of the spherical peripheral surface of the golf ball by the circles of intersection, i.e., by the dimples, which is relatively great, and each area of the spherical peripheral surface existing between the circles of intersection has a negligible surface with respect to the surface included in each of the immediately adjacent circles of intersection.

The subdivision envisioned according to the present invention likewise has an advantage in terms of the ease in the manufacture of the ball.

In effect, by virtue of the homogeneity obtained in the distribution of circles of intersection, i.e., the dimples, it is possible that at least one predetermined equatorial circle, amongst the said equatorial circles, does not cut any circle of intersection. This defined circle can correspond to a junction plane when the ball is formed by the assembly of two identical halves when at least one superficial layer thereof, comprising the dimples, is formed by molding out of a single piece in a mold, which is itself formed of two identical assembled halves. One can then allow that one of the halves of the ball or of the mold, respectively, is angularly offset with respect to the other half around the axis of the previously noted predefined equatorial circle. This angular offset remains practically without consequence, the orientation of the ball during the impact being practically unaffected by virtue of using the present invention.

Naturally, in the case of such an angular offset, the said predefined equatorial circle subdivides each of the other of the said equatorial circles into two arcs of a circle, or which each corresponds to one of the two hemispheres defined by the said predetermined equatorial circle, and the arcs of a circle of one of the hemispheres are angularly offset, with respect to the arcs of the equatorial circle which respectively correspond to the other of the hemispheres, by the same value around the axis of the said predetermined equatorial circle.

By allowing such an arrangement considerably facilitates the manufacture of the ball by assembly of the two halves or by molding in a mold formed of two assembled halves, when it is not necessary to perform a precise adjustment of the relative angular position of the two halves of the ball or of the mold, respectively, during manufacture of the ball.

Naturally, one can likewise provide that none of the equatorial circles cuts a circle of intersection.

Further, it is contemplated that the dimples can define shapes other than circles of intersection. Specifically, the dimples can be polygonal, such as square or pentagonal, or substantially polygonal.

In fact, the invention can be more broadly characterized as a golf ball having a generally spherical peripheral surface and including dimples, the dimples being arranged in predetermined patterns generally within a plurality of elemental surfaces defined by arcs of six equatorial circles of a sphere, in which the plurality of elemental surfaces include: a plurality of first elemental surfaces in the form of spherical irregular pentagons; a plurality of second element surfaces in the form of spherical equilateral triangles; and a plurality of third elemental surfaces in the form of spherical isosceles triangles.

Further, as mentioned above, the plurality of first elemental surfaces equals twelve, the plurality of second elemental surfaces equals eight, and the plurality of third elemental surfaces equals twelve. Each of the first elemental surfaces contains twenty-three dimples; each of the second elemental surfaces contains ten dimples; and each of the third elemental surfaces contains three dimples.

Further, each of the plurality of first elemental surfaces contains an equal first number of dimples arranged in an identical first pattern; each of the plurality of second elemental surfaces contains an equal second number of dimples arranged in an identical second pattern; and each of the plurality of third elemental surfaces contains an equal third number of dimples arranged in an identical third pattern.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
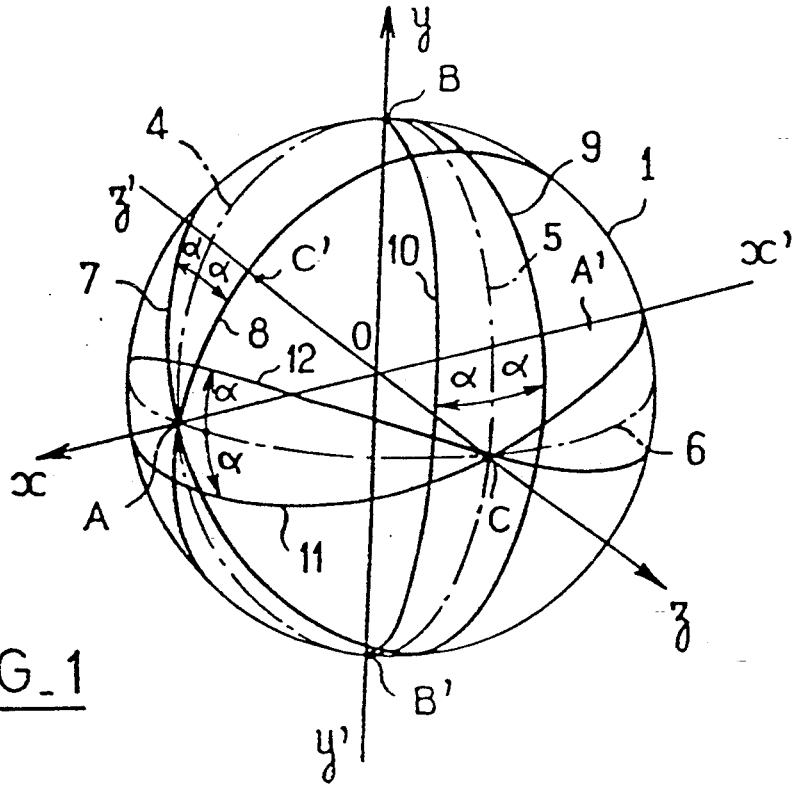
FIG. 1 illustrates the construction, according to the present invention, of six equatorial circles on a sphere.
Figure 2:
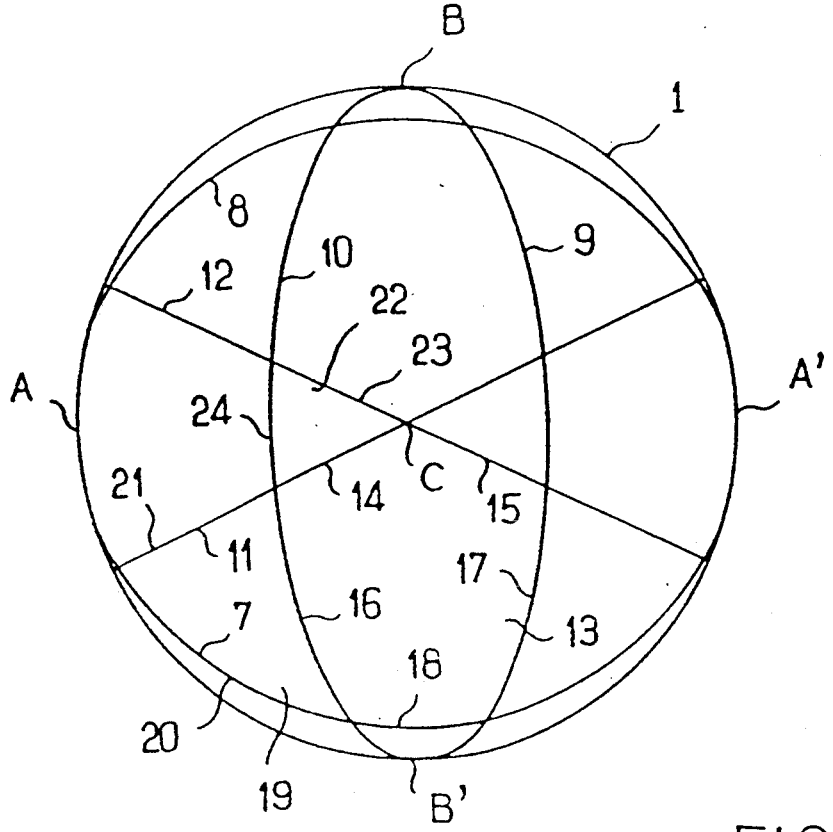
FIG. 2 illustrates the six equatorial circles.
Figure 3:
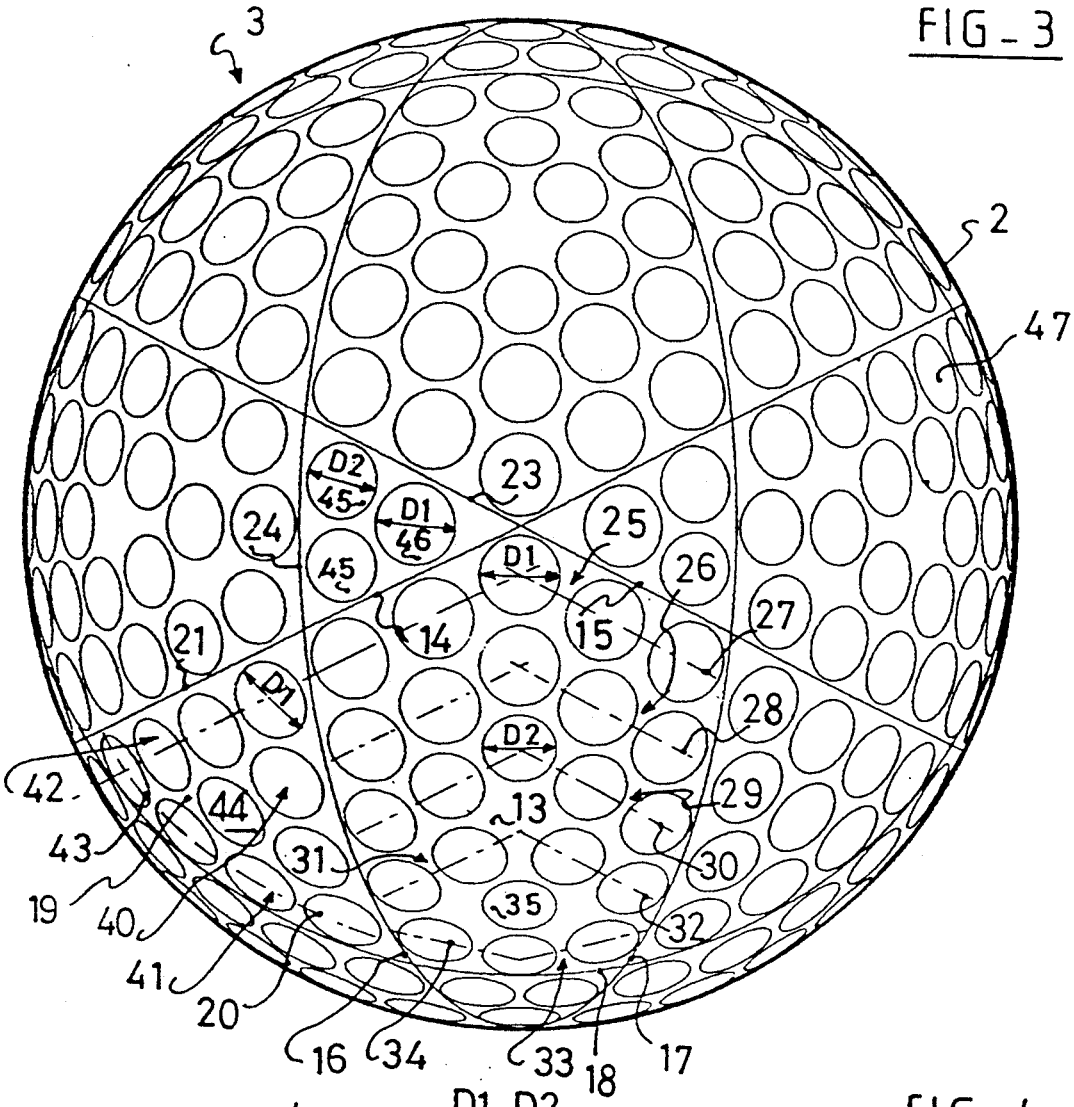
FIG. 3 illustrates a golf ball whose dimples or, more precisely, the circles of intersection of these dimples with the peripheral surface of the ball, are distributed in the elemental surfaces obtained by this subdivision by means of six equatorial circles.

With reference initially to FIGS. 1 and 2, a sphere 1 is illustrated, having the form of a peripheral surface 2 of a golf ball 3, which is illustrated in FIG. 3. In FIG. 1, O designates the center of the sphere and x'x, y'y, z'z, respectively, illustrate the three axes, each respective pair of which intersect, at a right angle, at the center O of the sphere 1. The three different pairs of the axes x'x, y'y, z'z define three equatorial planes which are likewise secant, two by two, at respective right angles, namely: the plane xOy, secant to the sphere 1 according to an equatorial circle 4; the plane yOz, secant to the sphere 1 along an equatorial circle 5; and the plane zOx, secant to the sphere 1 along an equatorial circle 6.

According to the present invention, six equatorial circles, distributed in three groups, can be traced on sphere 1, of which each is associated with one, respectively, of the planes xOy, yOz, and zOx, as well as with one, respectively, of the axes x'x, y'y, and z'z.

More precisely, if one were to designate, by A' and A, the points of intersection of the axis x'x with sphere 1, as well as with the equatorial circles 4 and 6; by B' and B, the intersection points of the axis y'y with the sphere 1 and with the equatorial circles 4 and 5; and by C' and C, the points of intersection of the axis z'z with sphere 1 and the equatorial circles 5 and 6, the following can be traced on the sphere 1:

- two equatorial circles 7 and 8, each of which intersects the points A' and A, and which is mutually symmetrical with respect to the plane xOy, with respect to which they are angularly offset, around axis x'x, by the same angle $\alpha$;
- two equatorial circles 9 and 10, each of which intersects the points B' and B, and which is mutually symmetrical with respect to the plane yOz, with respect to which they are angularly offset, around axis y'y, by the same angle $\alpha$ as the equatorial circles 7 and 8 with respect to the plane xOy; and
- two equatorial circles 11 and 12, each of which intersects the points C' and C, and which is offset angularly with respect to the plane zOx, around the axis z'z, by the same angle $\alpha$ as the equatorial circles 7 and 8 and the equatorial circles 9 and 10 with respect to the plane xOy and the plane yOz, respectively.

The six equatorial circles 7, 8, 9, 10, 11, 12 are also illustrated in FIG. 2, as well as in FIG. 3, on the peripheral spherical surface 2 of the golf ball 3, but it is not necessary that these circles be formed on surface 2.

According to the present invention, the angle $\alpha$ is less than 45° and is different from 0°, from 45°, and from 31° 43' 03".

Thus, the six equatorial circles 7, 8, 9, 10, 11, 12 mutually cut one another by defining, on the peripheral spherical surface 2 of golf ball 3, elemental surfaces, each in the form of a spherical polygon of which arcs of the aforementioned circles constitute the sides, namely:

- twelve first identical elemental surfaces 13, each in the form of an irregular spherical pentagon, defined by two first arcs 14 and 15 which have an identical length and mutually intersect, two second arcs 16 and 17, which likewise have the same length and of which each intersects a first respective arc 14 and 15, and a third arc 18 which intersects the two second arcs 16 and 17;
- eight second identical elemental surfaces 19, each in the form of a spherical equilateral triangle, defined by three arcs of a circle 16, 20, 21 which have the same length and of which each is aligned with a second arc of a circle of a first elemental surface such as 13, respectively; and
- twelve elemental identical third surfaces 22, each in the form of a spherical isosceles triangle, defined by two arcs of a circle of the same length 14 and 23, each of which is aligned with a first arc of a circle of a first elemental surface such as 13, respectively, and by an arc of a circle 24, forming a base of the isosceles triangle, and being aligned with a third arc of a circle with a first elemental surface such as 13, respectively.

Figure 4:
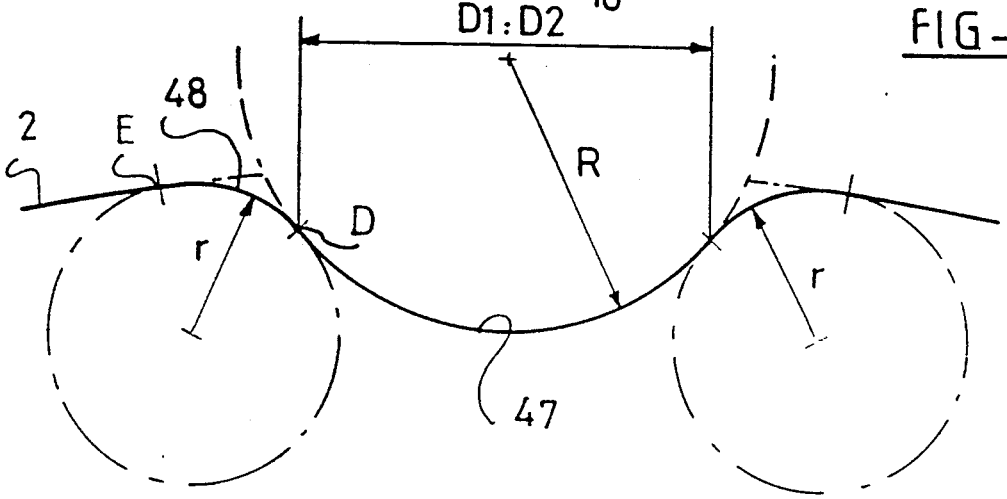
FIG. 4 illustrates, in a cross-sectional view, the particular preferred geometry of the dimples.

In a manner known, per se, in the peripheral surface 2, which is the spherical surface of the ball 3, dimples 47 are provided, illustrated in FIG. 4, which have, for example, the shape of spherical recesses and define circles by virtue of their intersection with the peripheral surface 2.

According to the present invention, the circles of intersection thus defined are distributed along predetermined patterns within the elemental surfaces 13, 19, 22, without overlapping any of the equatorial circles 7, 8, 9, 10, 11, 12, in the example illustrated, even though overlapping is allowable to a certain extent. Preferably, however, at least one of these equatorial circles does not cut any of the intersection circles of the dimples with the peripheral surface 2 of the ball 3 to correspond to a junction plane between two halves of the ball, if it is formed from halves, or between two halves of a mold adapted for forming the ball, or at least one superficial layer thereof, comprising the dimples, that of a single piece by molding. In a manner not shown, this predefined equatorial circle can then subdivide each of the other equatorial circles into two arcs of an equatorial circle which are mutually offset angularly, by the same value, around the axis (not shown) of this equatorial circle, which does not cause any major inconvenience as has been indicated above.

Preferably, although one does not go beyond the scope of the present invention by adopting a different arrangement, the respective patterns of distribution of the dimples, i.e., of the circles of intersection of the latter with the peripheral surface of the ball, are identical from one first elemental surface 13 to the other, from one second elemental surface 19 to the other, and from one elemental third surface 22 to the other. The manner of carrying out the invention illustrated in FIG. 3 adopts this preferred arrangement, in a manner which will now be described in greater detail.

This method of performing the invention corresponds to the preferred embodiment in which the value of the angle $\alpha$ is on the order of 26.29°, it being understood that it is not beyond the scope of the present invention to adopt different values, within the limits indicated above.

In this embodiment of the invention, each first elemental surface 13 comprises twenty-three circles of intersection distributed into:

- two rows 25 and 26, each in the form of a V of five first circles of intersection 27, 28 of the same diameter D1, which are mutually adjacent, of which the circles of intersection 27 of the first row are adjacent to the two first arcs 14 and 15; two first circles of intersection 27 and 28 which are extreme of the two rows 25 and 26, being respectively adjacent to the second respective arcs 16 and 17;
- a third row 29 in the form of a V of five second circles of intersection 30 of the same diameter D2, which are mutually adjacent and, furthermore, which are adjacent to the second row 26 of the first circles of intersection 28, two second end circles of intersection 30 being respectively adjacent to the second respective arcs 16 and 17;

a fourth row 31 which is substantially in the form of a V of four third circles of intersection 32 of the same diameter D2, which are adjacent, two by two, and, furthermore, which are adjacent to the third row 29, two end third circles of intersection 32 being respectively adjacent to the two respective arcs 16 and 17;

a fifth row 33 of three fourth circles of intersection 34 of the same diameter D2, which are mutually adjacent and, furthermore, which are adjacent to the third arc 18 connecting the two second arcs 16 and 17; two of the three fourth circles 34, which are extreme, being respectively adjacent to the second respective arcs 16 and 17; and a fifth circle of intersection 35 of diameter D2, which is adjacent to each of two third circles of intersection 32 of the fourth row 31 and to the fourth circle of intersection 34 which is median of the fifth row 33.

The diameters D1 and D2 can be easily defined by one of ordinary skill in the art to the extent that the positions previously described of the circles of intersection correspond to a first elemental surface 13.

In the preceding description, as well as in the following, it is to be understood that the term "adjacent," with respect to a circle of intersection of a dimple with the peripheral surface 2 of the ball 3, is with respect to two circles of intersection, or with respect to a circle of intersection and an arc of a circle defining the elemental surface which essentially contains the circles of intersection, i.e., a tangential relation or a mutual spacing, such that the value is small with respect to the diameter of the concerned circles of intersection and, for example, at most is equal to a quarter of this diameter, this value being given as a non-limiting example.

In the example illustrated, furthermore, each second elemental surface 19 comprises ten circles of intersection of the same diameter D1 as the first circles of intersection, and these ten circles are distributed into:

three rows 40, 41, 42 of four circles of intersection 43 which are mutually adjacent and adjacent to a respective arc 16, 20, 21, each row 40, 41, 42 having two end intersection circles 43 common to a row 40, 41, 42 which is adjacent, respectively, to two intermediate intersection circles 43, and a central intersection circle 44 adjacent to these intermediate intersection circles 43 of the three rows 40, 41, 42.

Finally, each third elemental surface 22 comprises three intersection circles distributed into:

two intersection circles 45 of diameter D2, adjacent to the arc of a circle 24 forming the base of the spherical isosceles triangle of the elemental surface; and an intersection circle 46 of diameter D1, adjacent to the two other circles of intersection 45.

The diameters D1 and D2 can have respective adjacent values, and, for example, for a ball 3 whose peripheral surface 2 has a diameter on the order of approximately 42.67 mm, is respectively on the order of approximately 3.5 mm, and approximately 3.2 mm.

Naturally, one can, however, select other arrangements of the intersection circles and the different elemental surfaces, related to a different choice of respective diameters of the circles of intersection, without going beyond the scope of the present invention.

The reduced number of different diameters for the different circles of intersections makes it possible to simplify the manufacture of the ball. That is, the corresponding dimples to these intersection circles are formed by machining directly on the peripheral spherical surface 2 thereof, in a manner rarely achieved, or in a master mold reproducing the ball 3, which is identical and serves to form molds of manufacture thereof, or of a superficial portion thereof, by molding.

The preferred geometry of the dimples formed according to the present invention is illustrated, two-dimensionally, in FIG. 4. The central portion of dimple 47 has the form of a spherical recess of radius R. The edges 48 of this recess are connected along a line corresponding to the arc of a circle of radius r tangent to the point E with the peripheral surface 2 of the ball and tangent to the point D with the surface of the spherical recess of radius R. In an arbitrary manner, but for practical reasons, for all which has preceded, it will be understood that the line of intersection of the spherical surface 2 with the plurality of dimples 47 corresponding to the intersection circles 27, 28, 30, 32, 34, 35, 43, 44, 45, 46 is a circular tangent line D, shown as a point in the two-dimensional schematic illustration of FIG. 4, and the diameters D1 and D2 are measured at D. Thus, the diameters D1 and D2 of the circles of intersection are determined as the diameter of the circular tangent line D.

Figure 5:
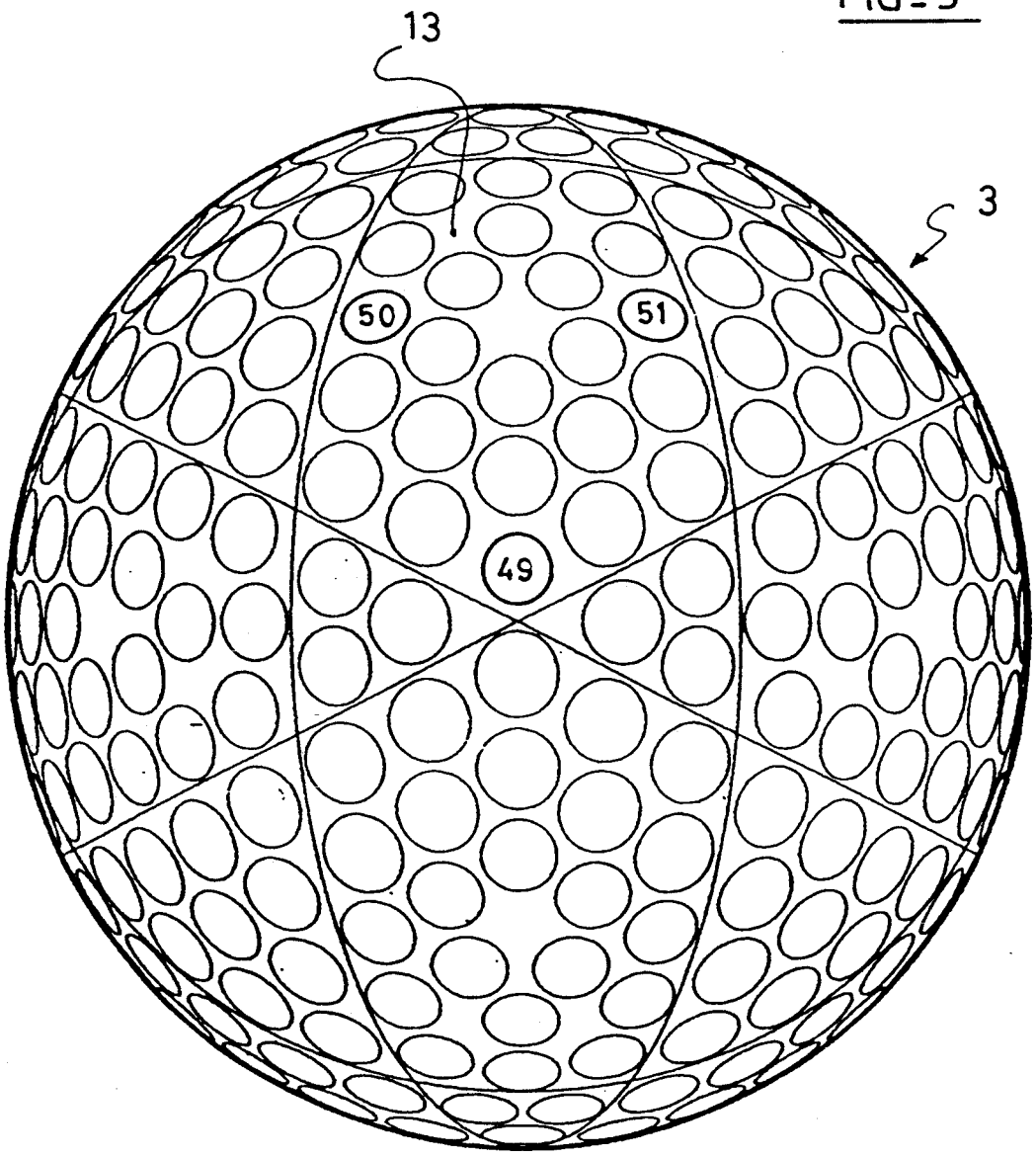
FIG. 5 illustrates another embodiment of a golf ball of the type of that of FIG. 3.

The distribution of the dimples 47 within the elemental surfaces of the ball as well as the choice of diameters is not limiting according to the invention. Thus, as shown in FIG. 5, one can advantageously provide that two of the twelve first identical elemental surfaces 13 in the form of an irregular spherical pentagon (and particularly two selected symmetrical with respect to one of the equatorial circles) allow three intersection circles (49, 50, 51) of a different diameter than that of the circles of intersection located at the same locations within the other elemental surfaces 13. These circles of intersection correspond in particular to the points of contact of the spindles during manufacture of the ball.

The instant application claims the priority of French Application 90.00857 filed Jan. 25, 1990, the disclosure of which is hereby incorporated, in its entirety, by reference thereto.

Finally, although the invention has been described with reference to particular means, materials and embodiments, the invention is not limited to the particulars disclosed and extends to all equivalents within the scope of the claims. In particular, although particular means of manufacture, dimensions and ratios have been disclosed, variations are possible while remaining within the scope and spirit of the invention.

What is claimed is:

1. A golf ball comprising:

a peripheral surface having the general shape of a sphere and a plurality of dimples provided in said peripheral surface, said dimples defining, by virtue of respective intersections between said dimples and said peripheral surface, circles of intersection distributed in a repeating pattern and generally bounded within elemental surfaces defined by arcs of six equatorial circles of said sphere;

said six equatorial circles being distributed into three groups of two equatorial circles, the two equatorial circles of each of said groups being associated, respectively, with one of three equatorial planes, said three equatorial planes intersecting, two by two, at right angles, along axes which themselves intersect, two by two, at right angles, at the center of said sphere, each of said two equatorial circles of said three groups of equatorial circles intersecting a respective one of said axes and being mutually symmetrical with a respective one of said equatorial planes, and each of the two equatorial circles of each of said three groups being angularly offset with respect to a respective equatorial plane by an angle $\alpha$ which is greater than zero, less than 45°, and not equal to 31° 43′ 03″, thereby defining said elemental surfaces as follows:

twelve identical first elemental surfaces in the form of spherical irregular pentagons;

eight identical second elemental surfaces in the form of spherical equilateral triangles; and twelve identical third elemental surfaces in the form of spherical isosceles triangles.

2. The golf ball as defined by claim 1, at least one of said equatorial circles not intersecting with any of said circles of intersection.

3. The golf ball as defined by claim 2, each of said equatorial circles subdividing each of the other equatorial circles into two equatorial circle arcs, each of which corresponding to one of the two hemispheres defined by said equatorial circles, and said equatorial circle arcs of one of the hemispheres being angularly offset with respect to the equatorial circle arcs respectively corresponding to the other hemispheres, by the same value around the axis of said equatorial circle.

4. The golf ball as defined by claim 2, none of said equatorial circles intersecting with any of said circles of intersection.

5. The golf ball as defined by claim 1, said circles of intersection being distributed along an identical pattern in respective ones of said identical elemental surfaces.

6. The golf ball as defined by claim 1, said angle $\alpha$ being approximately 26.29°.

7. The golf ball as defined by claim 6, wherein:

(a) each of said first elemental surfaces are defined by two first arcs of the same length, which are mutually adjacent, two second arcs of the same length, each of which each is adjacent to one of said first arcs, respectively, and a third arc mutually connecting said two second arcs, each of said first elemental surfaces bounding twenty-three circles of intersection, namely:

(i) two rows, each in the form of a V comprising five first circles of intersection of the same diameter D1, which are mutually adjacent, and whose circles of intersection of the first row are adjacent to the two first arcs, two extreme first circles of intersection of the two rows being respectively adjacent to the second respective arcs;

(ii) a third row, in the form of a V comprising five second circles of intersection of the same diameter D2, which are mutually adjacent and adjacent to the second row of the first circles of intersection, two extreme second circles of intersection being respectively adjacent to the second respective arcs;

(iii) a fourth row, comprising four third circles of intersection of the same diameter D2, which are mutually adjacent and adjacent to the third row, two extreme third circles of intersection being respectively adjacent to the second respective arcs;

(iv) a fifth row, comprising three fourth circles of intersection of the same diameter D2, which are mutually adjacent and adjacent to the third arc connecting the two second arcs; two of the three fourth extreme circles being adjacent respectively to the respective second arcs; and (v) a fifth circle of intersection of diameter D2, which is respectively adjacent to the two third circles of intersection of the fourth row and to the fourth circle of median intersection of the fifth row;

(b) each second elemental surface comprises ten circles of intersection of the same diameter D1 as the first circles of intersection, distributed into three rows of four circles of intersection which are mutually adjacent and adjacent to a respective arc, each row having two end circles of intersection which are common to a respective adjacent row, two intermediate circles of intersection, and a central intersection circle adjacent to the intermediate intersection circles of the three rows; and (c) each of said third elemental surfaces comprising three circles of intersection which are distributed into:

(i) two circles of intersection of diameter D2 which are adjacent to the circular arc forming the base of the spherical isosceles triangle of the elemental surface; and (ii) a circle of intersection of diameter D1 adjacent to the two other circles of intersection.

8. The golf ball as defined by claim 7, said spherical surface having a diameter of approximately 42.67 mm, said diameter D1 being approximately equal to 3.5 mm, and diameter D2 being approximately equal to 3.2 mm.

9. A golf ball comprising:

a peripheral surface, generally having the shape of a sphere, said peripheral surface having a plurality of dimples, said dimples being arranged in predetermined patterns generally within a plurality of elemental surfaces defined by arcs of six equatorial circles of said sphere, said plurality of elemental surfaces comprising:

a plurality of first elemental surfaces in the form of spherical irregular pentagons;

a plurality of second elemental surfaces in the form of spherical equilateral triangles; and a plurality of third elemental surfaces in the form of spherical isosceles triangles.

10. The golf ball of claim 9, said plurality of first elemental surfaces equals twelve, said plurality of second elemental surfaces equals eight, and said plurality of third elemental surfaces equals twelve.

11. The golf ball of claim 10, each of said first elemental surfaces containing twenty-three dimples, each of said second elemental surfaces containing ten dimples, and each of said third elemental surfaces containing three dimples.

12. The golf ball of claim 11, having a diameter of approximately 42.67 mm, and substantially all of said dimples having either of two predetermined sizes.

13. The golf ball of claim 12, said dimples being partially spherical recesses within said peripheral surface, and said two predetermined sizes being diameters of approximately 3.2 mm and 3.5 mm.

14. The golf ball of claim 9, said dimples having a total area comprising approximately 61% of said peripheral surface.

15. The golf ball of claim 9, formed by the joining of two portions generally at an equatorial plane, none of said dimples intersecting said equatorial plane.

16. The golf ball of claim 9, each of said plurality of first elemental surfaces containing an equal first number of said dimples arranged in an identical first pattern; each of said plurality of second elemental surfaces containing an equal second number of said dimples arranged in an identical second pattern; and each of said plurality of third elemental surfaces containing an equal third number of said dimples arranged in an identical third pattern.

* * * * *